US006330731B1

(12) United States Patent
Jackson et al.

(10) Patent No.: US 6,330,731 B1
(45) Date of Patent: Dec. 18, 2001

(54) FAUX FINISH APPLICATOR

(75) Inventors: Susan A. Jackson, Plymouth; Martin L. Eull, Maple Grove, both of MN (US)

(73) Assignee: Wagner Spray Tech Corporation, Minneapolis, MN (US)

( * ) Notice: Subject to any disclaimer, the term of this patent is extended or adjusted under 35 U.S.C. 154(b) by 0 days.

(21) Appl. No.: 09/165,965

(22) Filed: Oct. 2, 1998

(51) Int. Cl.[7] ..... B05C 17/02

(52) U.S. Cl. ..... 15/230.11; 492/13; 492/19; D4/123

(58) Field of Search ..... 15/210.5, 230.11; 492/13, 19, 28, 30; D4/122, 123

(56) References Cited

U.S. PATENT DOCUMENTS

| | | | | |
|---|---|---|---|---|
| D. 220,850 | | 6/1971 | Davis | D4/123 |
| 2,321,511 | * | 6/1943 | Piercy | 15/230.11 X |
| 2,630,592 | | 3/1953 | Sultanik et al. | 401/218 |
| 2,680,873 | * | 6/1954 | Ernst | 15/230.11 X |
| 2,694,874 | * | 11/1954 | Coolidge, Jr. et al. | 492/13 X |
| 2,805,436 | * | 9/1957 | Christensen et al. | 492/28 X |
| 3,448,479 | * | 6/1969 | Cademartori | 15/230.11 |
| 4,191,792 | | 3/1980 | Janssen | 427/260 |
| 4,201,801 | | 5/1980 | Hori | 427/274 |
| 4,257,140 | | 3/1981 | Downing | 15/230.11 |
| 4,293,599 | | 10/1981 | Hori et al. | 427/274 |
| 4,404,703 | | 9/1983 | Woodall, Jr. et al. | 15/230.11 |
| 4,434,521 | | 3/1984 | Martin et al. | 15/230.11 |
| 4,630,952 | | 12/1986 | Elbaum | 401/48 |
| 4,919,975 | | 4/1990 | Jones | 427/260 |
| 4,930,179 | | 6/1990 | Wright et al. | 15/230.11 |
| 5,117,529 | | 6/1992 | Ohta | 15/230.11 |
| 5,206,979 | | 5/1993 | Campbell | 492/13 |
| 5,471,703 | | 12/1995 | Niven | 15/230.11 |
| 5,571,562 | | 11/1996 | Wakat | 427/280 |
| 5,577,291 | | 11/1996 | Myers et al. | 15/230.11 |
| 5,693,141 | | 12/1997 | Tramont | 118/211 |
| 5,713,095 | | 2/1998 | Wakat | 15/230.11 |
| 5,966,772 | * | 10/1999 | Woodnorth et al. | 15/230.11 |
| 5,970,568 | * | 10/1999 | Mulcahy, Sr. | 15/230.11 |
| 5,980,802 | * | 11/1999 | Wakat et al. | 15/230.11 X |

FOREIGN PATENT DOCUMENTS

| | | | |
|---|---|---|---|
| 476613 | | 8/1951 | (CA) . |
| 191483 | | 9/1937 | (CH) . |
| 3616114 | | 11/1987 | (DE) . |
| 2489175 | | 3/1982 | (FR) . |
| 1512967 | * | 6/1978 | (GB) ..... 15/230.11 |
| 9002-017 | | 4/1991 | (NL) . |
| 80213 | | 5/1952 | (NO) . |
| 694228 | | 12/1979 | (SU) . |

OTHER PUBLICATIONS

Decorative Painting 81 Projects & Ideas for the Home, The Home Decorating Institute; Cy DeCosse, Inc., 1994; pp 88–117.

Color– A Stroke of Brilliance, A Guide to Color & Decorating with Paint; Leslie Harringont, Benjamin Moore & Co., 1993; pp 104–107.

* cited by examiner

*Primary Examiner*—Mark Spisich
(74) *Attorney, Agent, or Firm*—Faegre & Benson LLP

(57) ABSTRACT

An apparatus and method for creating a faux finish on a surface where the apparatus has a dual roller handle, a pair of roller covers each mounted for independent rotation, and at least one raised foam pattern on each roller cover. In one embodiment, the raised foam pattern is a nonrepresentational design that is sized, shaped and positioned on each roller cover to create smoothly contoured edges and a non-uniform gap between adjacent edges of the raised foam pattern. When two paints having at least one different visually perceptible characteristic are respectively applied to the surface by the roller covers using the handle in an overlapping and arcing motion, a faux marble finish results from the effect of the edges of the raised foam pattern on the paint discharged to the surface by the raised foam pattern. In another embodiment, the raised foam pattern is a representative design that is used in the same manner to provide a faux texture finish.

30 Claims, 14 Drawing Sheets

(5 of 14 Drawing Sheet(s) Filed in Color)

FAUX FINISH APPLICATOR

This invention relates to apparatus and methods for creating a faux finish on a surface.

BACKGROUND OF THE INVENTION

The creation of faux finishes on objects and surfaces has been achieved in the past by various methods. These methods have proven to be time consuming and tedious due to the necessity of carrying out multiple steps to achieve the desired aesthetic effect. As a result, the cost of obtaining these faux finishes may be prohibitively high, or require an excessive time commitment on the part of the painter.

Examples of such faux finishes include faux marble, giving a surface the appearance of being marble, and faux texture, giving the surface the appearance of depth or texture. Both of these faux finishes are aesthetically desirable, but expensive and time consuming to produce by known methods. Faux marble methods usually include applying multiple sponge painted layers of paint over the surface or object, usually with drying time required between each successive layer. After the sponge painting is complete, applying random line-type marks is typically accomplished by feather painting techniques to produce a "veined" appearance often found in marble. Faux texture methods usually include applying multiple layers of paint or other coating over the surface or object using various techniques known in the art, usually with drying time required between each successive layer. For example, a faux texture finish giving the appearance of overlapping leaves would require the application of numerous layers of leaf images, as well as the creation of blended areas and other subtle effects.

Other methods of achieving such faux finishes include the application of faux finish wallpaper. However, the use of wallpaper also has its problems, including being expensive, time consuming to install, having a short life span, and lacking the randomness of the true finish.

SUMMARY OF THE INVENTION

The present invention overcomes these shortcomings by providing an apparatus and method for creating faux finishes using a simple, hand held paint applicator. This apparatus is a roller paint applicator having at least two rollers mounted for independent rotation. Each roller has at least one raised foam pattern on it. Use of the present invention simplifies the method of producing faux finishes by reducing the steps needed. These steps include applying at least two paints to the applicator rollers, at least one paint per roller, and then simultaneously applying the paints to the surface to be coated using the applicator. This method greatly reduces the time and complexity of the prior methods, thereby also reducing the cost and other barriers to obtaining such a finish, as well as the amount of effort and time needed for cleanup.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION

Figure 1:
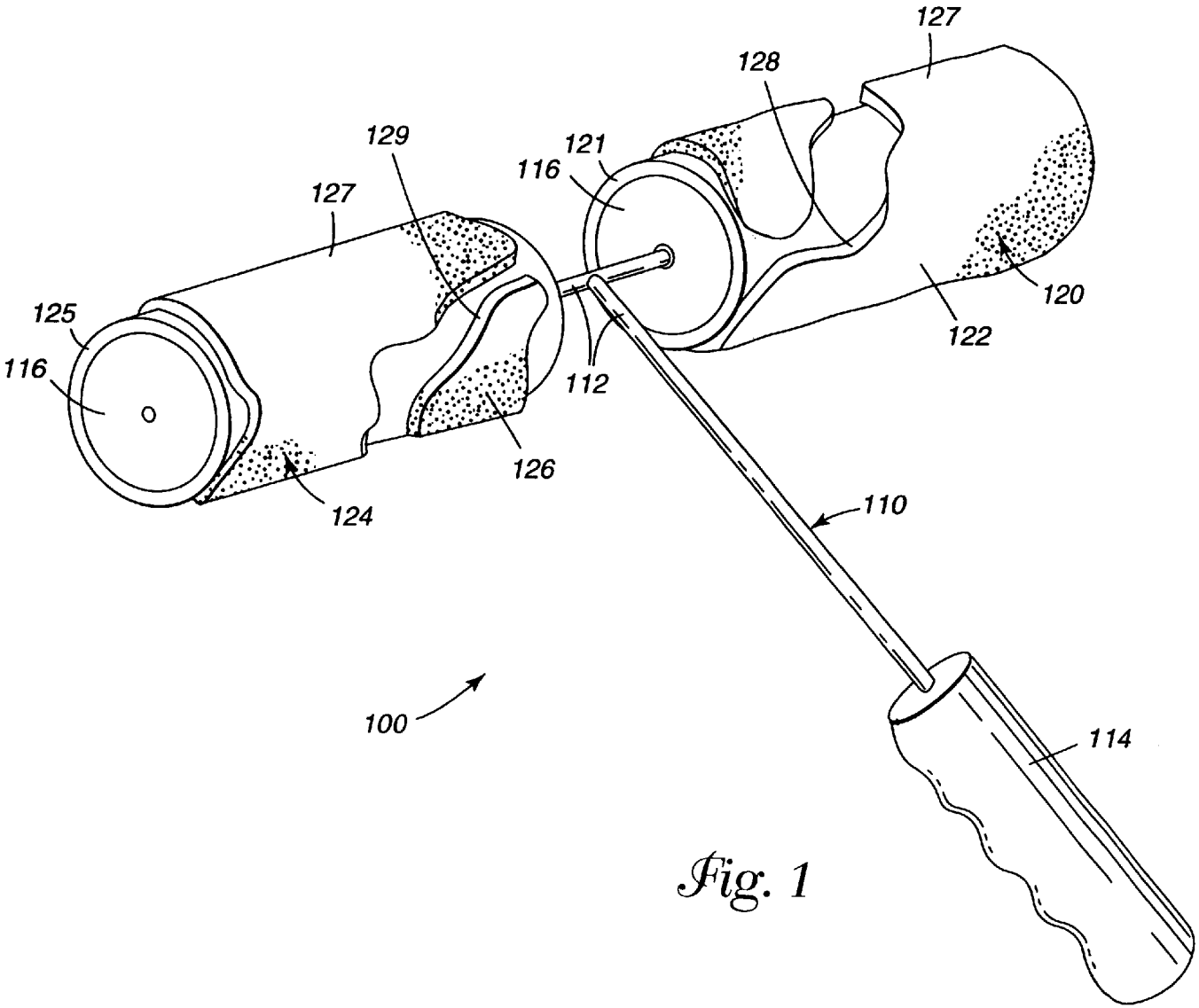
FIG. 1 is a perspective view of a dual roller paint applicator with two roller covers mounted thereon useful in the practice of the present invention.

With reference to the attached Figures, it is to be understood that like components are labeled with like numerals throughout the several Figures. FIG. 1 illustrates a dual roller paint applicator 100 useful in the present invention for creating a faux finish on a surface to be coated or painted. As used herein, a faux finish is a surface treatment that produces the illusion of qualities, such as tactile, textural, spatial or material qualities, that are not inherent to the surface treated. The dual roller paint applicator 100 includes a roller handle 110 and two roller mechanisms 116 each mounted for independent rotation. The roller handle 110 includes a grip 114 and a T-shaft 112 to which the roller mechanisms 116 are mounted.

Two roller covers 120, 124 are mounted on the roller mechanisms 116 to complete the dual roller paint applicator 100. These two roller covers 120, 124 are labeled as a right-hand roller cover 120 and a left-hand roller cover 124 with reference to the illustration in FIG. 1 only. Each roller cover 120, 124 comprises a core 121, 125 and a foam layer 122, 126, and each cover is preferably removable and interchangeable to allow for versatility in the use of the dual roller paint applicator 100 and ease of cleanup. Although each roller cover 120, 124 may be different, it is preferable to use two roller covers 120, 124 of the same type and design to achieve the desired faux finish. In addition, one roller cover 120, 124 may be completely covered by a foam layer, instead of a patterned foam layer.

The core 121 may formed from a number of materials, including, but not limited to paper, cardboard, phenolic, or plastic, such as PVC. The core 121 may be disposable or reusable, but preferably is capable of being used and washed enough times to allow for at least the complete application of a faux finish to an entire reasonably sized room. The core 121 can be sized to meet application requirements, both in length and diameter, however ease of use can provide practical limitations on size. For example, if the core 121 is too large, the weight of a dual roller applicator when loaded with paint can pose fatigue and control problems for the user. If, on the other hand, the core 121 is too small, the amount of surface area coverage is limited, thus requiring more time and effort to produce a faux finish on an entire surface. Preferably, the core 121 will be sized between 4 and 7 inches in length, and 1.5 to 1.75 inches in diameter. The thickness of the core 121 can vary depending on the strength of the material chosen. Preferably, however, the thickness will follow industry standards in the range of about 1/16 to 1/8 inches.

The foam layer 122, 126 is preferably formed from an open cell foam to allow for the absorption of paint or other coating material. Properties of the foam, such as density and pore count, may be varied depending on the type of faux finish desired. For a more abstract finish, it has been found that a softer foam is preferable with a density in the range of 1.9±0.1 pounds per cubic foot, and a pore count in the range of 55 to 65 pores per inch. An example of a suitable foam is a polyester polyurethane foam produced by Crest Foam Industries, Product Code BS060CHA00. For a more defined and textured finish, a foam that may have the same density in the range of 1.9±0.1 pounds per cubic foot is preferred, but with a higher pore count than the foam used for more abstract finishes, preferably in the range of 70 to 90 pores per inch. An example of a suitable foam is a polyester polyurethane foam produced by Crest Foam Industries, Product Code BS080CHA00. The thickness of the foam layer 122, 126 can vary depending on the faux finish desired, but is preferably in the range between about 0.25 and about 0.5 inches.

Although a T-shaft type dual roller paint applicator 100 is shown, the present invention is not limited to this specific roller paint applicator design. Any other type of roller paint applicator, now known or later designed, providing independent rotational mounting for at least two roller covers is also contemplated for use with the present invention. It is to be understood, however, that it is preferable to be able to simultaneously load each roller cover with paint to maintain efficiency.

The foam layers 122, 126 of the roller covers 120, 124 may be formed into foam patterns to produce different faux finishes on a surface. A number of specific foam patterns are described below representing different pattern possibilities. The method of creating a faux finish using these foam patterns and the dual roller paint applicator 100 is then discussed, and the resulting faux finishes from the specific foam patterns are described.

Figure 3:
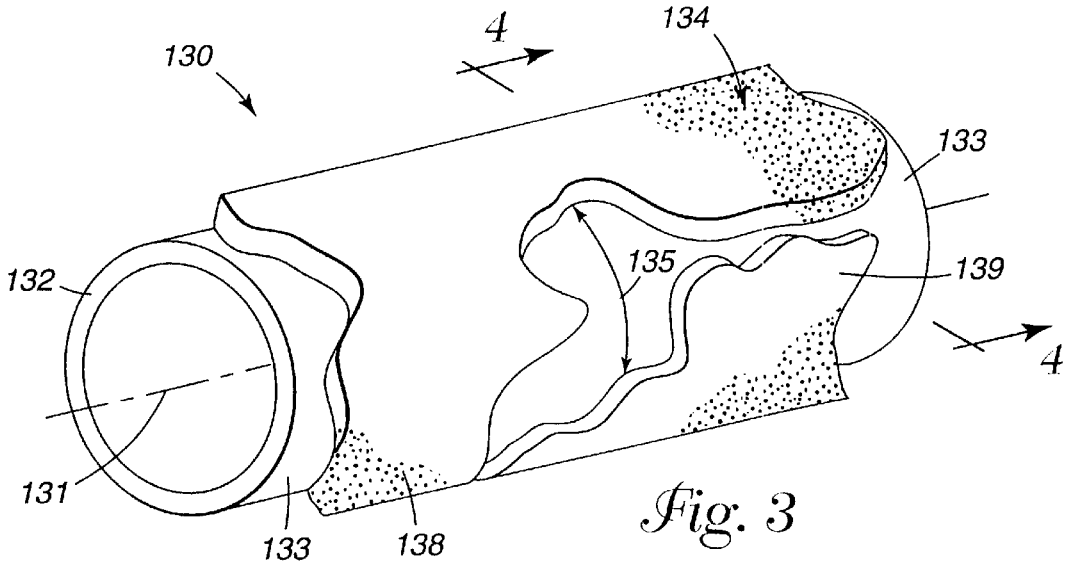
FIG. 3 is a perspective view of a roller cover useable with the roller paint applicator of FIG. 1, having a single raised foam pattern.
Figure 4:
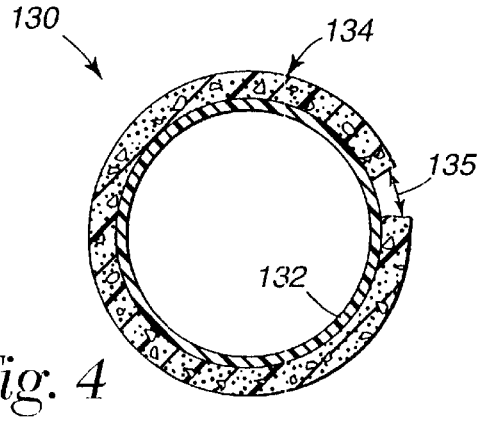
FIG. 4 is a cross-sectional view of the roller cover of FIG. 3 taken along line 4—4.
Figure 5:
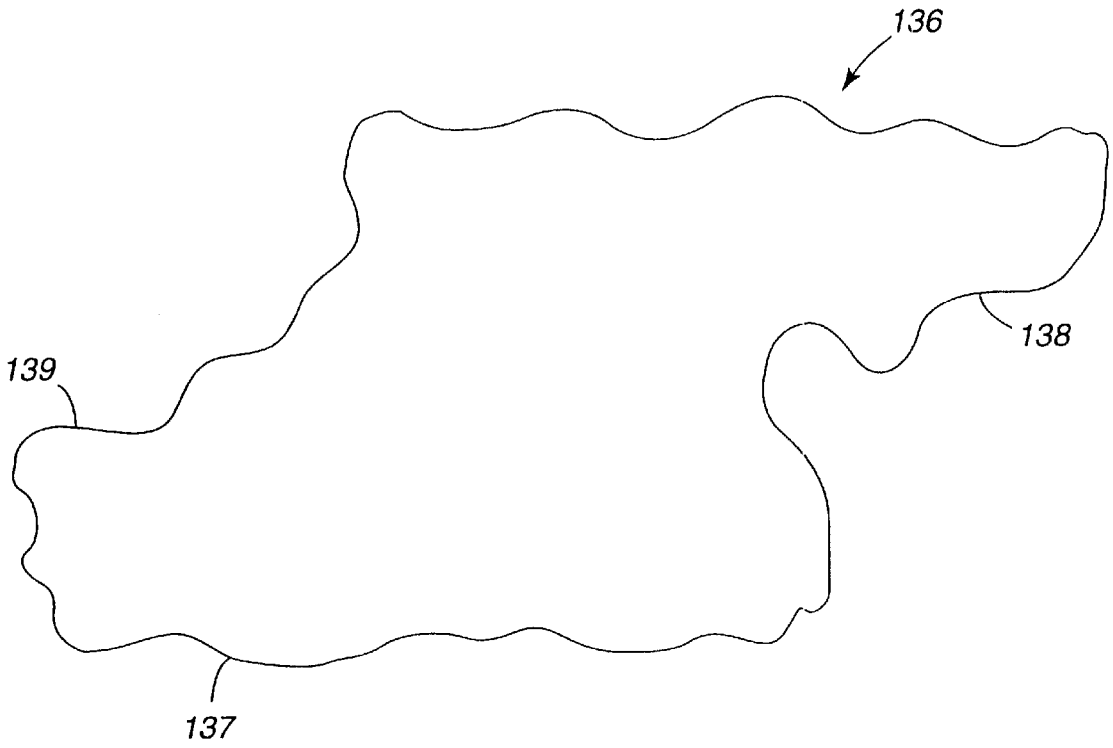
FIG. 5 is a plan view of the raised foam pattern of the roller cover of FIG. 3 as it would appear in a plane.

FIGS. 3, 4 and 5 illustrate one embodiment of a roller cover 130 comprising a core 132 and a foam layer 134 formed into a single, nonrepresentational foam pattern 136. The single foam pattern 136 is an abstract design with an undulating periphery 137 and opposing protrusions 138, 139, as shown in FIG. 5. The undulating periphery 137 is characterized by gently wavy edges, gradual turns and few sharp bends. The foam layer 134 is preferably smoothly wrapped around and attached to the core 132 so that the core 132 is substantially covered by the foam layer 134. The foam layer 134 is positioned on the core 132 to leave side regions 133 of the core 132 free of foam. Each side region 133 is preferably in the range between about 0.125 and about 0.25 inches. These foam-free side regions 133 facilitate packaging and storage, and help reduce wear and tear on the exposed edges of the foam layer 134. The protrusions 138, 139 in the foam pattern 136 generally engage but do not touch each other when the foam layer 134 is wrapped about the core 132, as shown in FIG. 3. This engagement allows the foam pattern 136 to extend around the core 132 without the foam layer 134 overlapping itself into a double layer of foam material. As a result of the engagement of the protrusions 138, 139, the edges of the foam layer 134 preferably form a non-uniform gap 135 that partially winds about the core 132.

The non-uniform gap 135 should preferably range in width between about 0.25 and about 0.5 inches. If the gap 135 is too small, the edges of the foam pattern 136 at the gap 135 are less effective to achieve the desired faux finish results. If the gap 135 is too large, excess paint or other coating may collect in the gap 135 and cause paint to blob, drip, and/or fling off the roller cover. The gap 135 preferably is not formed parallel to the axis 131 of the roller cover 130, but rather is preferably oriented generally along a spiral path about the core 132 to some extent. Gaps 135 that are formed generally parallel along the axis 131 of the roller cover 130 have been found to have a greater tendency to collect paint and fling it off the roller.

Figure 6:
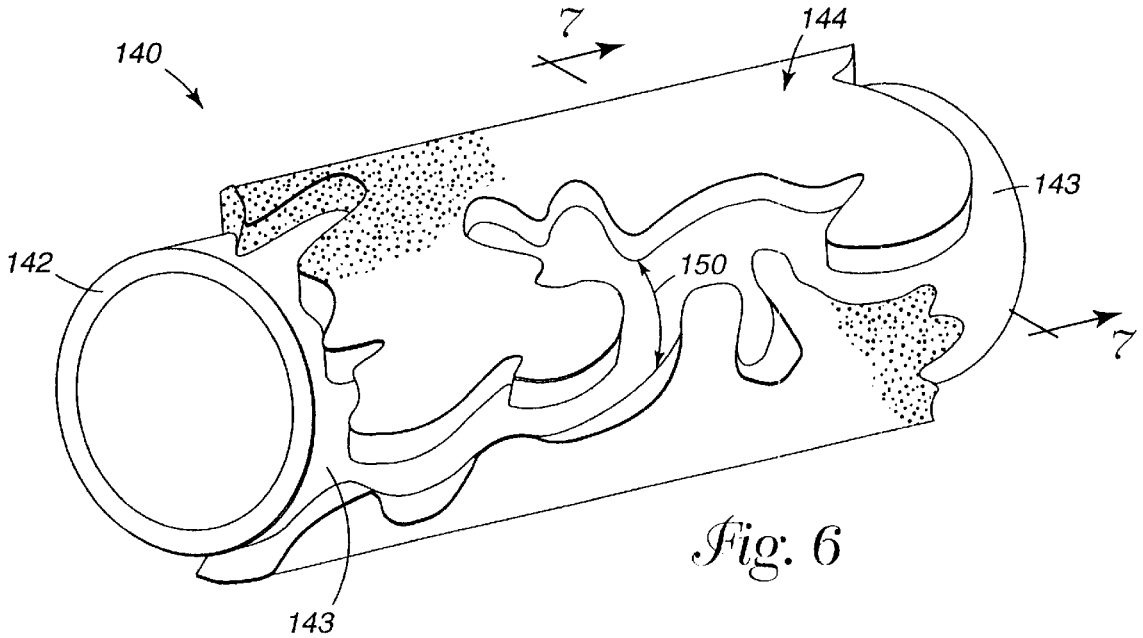
FIG. 6 is a perspective view of another roller cover useable with the dual roller paint applicator of FIG. 1, having two raised foam patterns.
Figure 7:
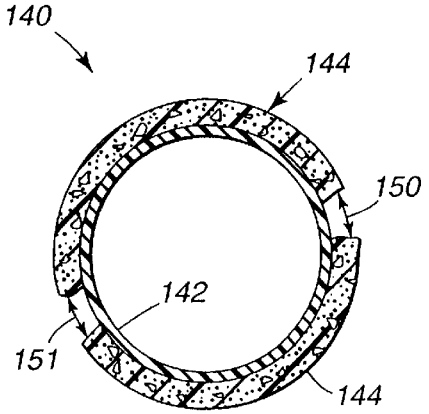
FIG. 7 is a cross-sectional view of the roller cover of FIG. 6 taken along line 7—7.
Figure 8:
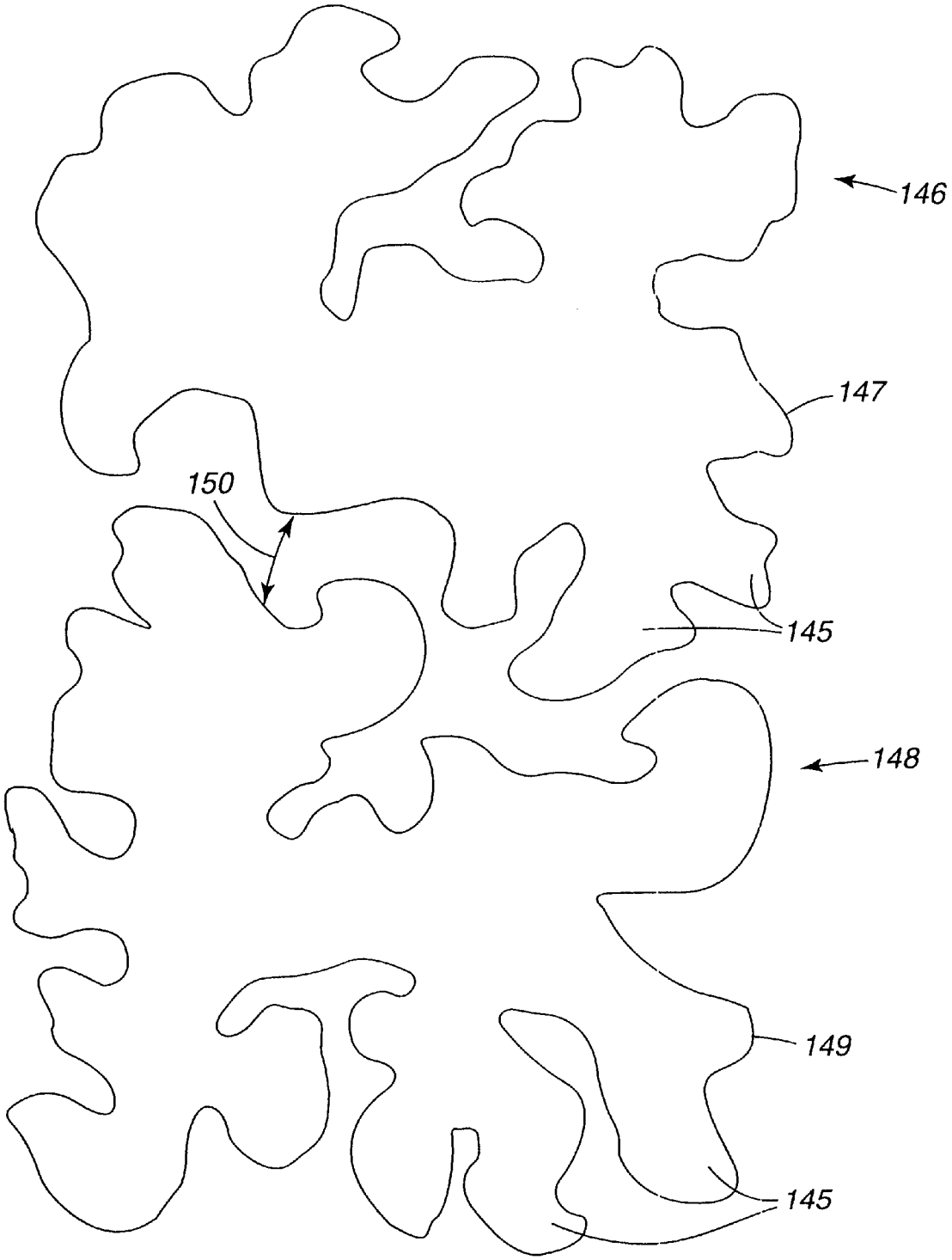
FIG. 8 is a plan view of the two raised foam patterns of the roller cover of FIG. 6 as it would appear in a plane.

FIGS. 6, 7 and 8 illustrate another embodiment of a roller cover 140 including a core 142 and a foam layer 144 formed into two nonrepresentational foam patterns 146, 148. The two foam patterns 146, 148 are each abstract designs with a serpentine periphery 147, 149 resulting in numerous irregular protrusions, representatively referenced as 145, best shown in FIG. 8. The serpentine periphery 147 is characterized by numerous sharp bends and turns, and a generally tortuous, winding edge. The foam layer 144 is preferably smoothly wrapped around and attached to the core 142 so that the core 142 is substantially covered by the foam layer 144. Side regions 143 are also provided, in the same manner as the embodiment above. Some of the numerous protrusions 145 in each foam pattern 146, 148 generally engage but do not touch each other when the foam layer 144 is wrapped about the core 142, as shown in FIG. 6. This non-contacting engagement allows the foam patterns 146, 148 to extend around the core 142 without the foam layer 144 overlapping itself into a double layer of foam material. As a result of the engagement of some of the protrusions 145 between the two patterns 146, 148, the edges of the foam layer 144 form two non-uniform gaps 150, 151 that each partially wind about the core 142, in a similar manner to the gap 135 described above.

Figure 9:
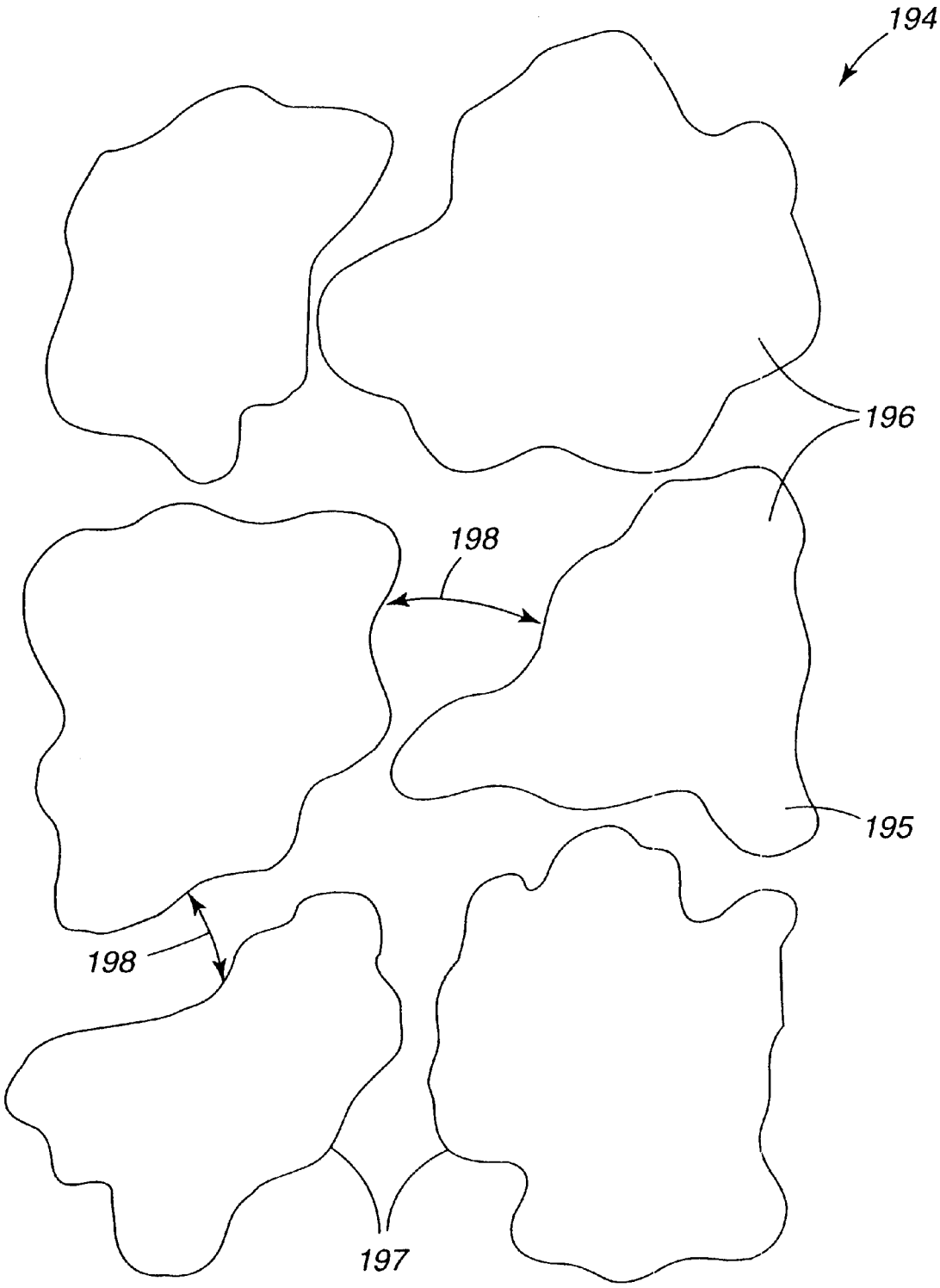
FIG. 9 is a plan view of a multiple foam pattern for use with yet another roller cover useable with the roller paint applicator of FIG. 1 as it would appear in a plane.

In the same manner as the two roller cover embodiments described above, FIG. 9 illustrates a foam layer 194 of another embodiment. The foam layer 194 is formed into six nonrepresentational foam patterns 196. The six foam patterns 196 are each abstract designs with undulating periphery 197 resulting in a few small protrusions, representatively referenced as 195. As with the prior two embodiments, the foam layer 194 is preferably smoothly wrapped around and attached to a core (not shown) so that the core is substantially covered by the foam layer 194 leaving side regions free of foam. Some of the protrusions 195 in each foam pattern 196 generally engage but again do not touch each other when the foam layer 194 is wrapped about a core. This non-contracting engagement allows the foam patterns 196 to extend around a core without the foam layer 194 overlapping itself into a double layer of foam material, in the same manner as that shown in FIGS. 3 and 6 for the previous embodiments. As a result of the engagement of some of the protrusions 195 between the six patterns 196, the periphery 197 of the foam patterns 196 form a number of non-uniform gaps, representatively referenced as 198, that would each partially wind about a core.

Figure 2:
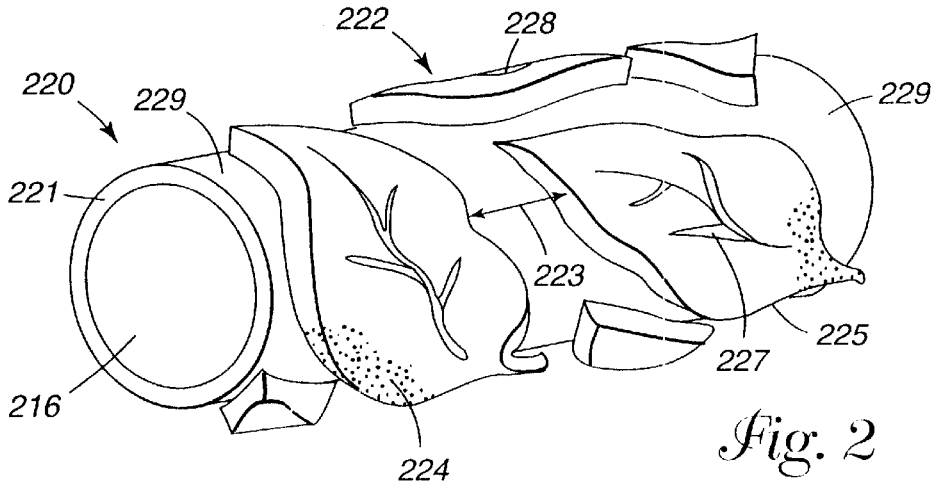
FIG. 2 is a perspective view of a roller cover useable with the roller paint applicator of FIG. 1, having multiple leaf shaped foam patterns.
Figure 10:
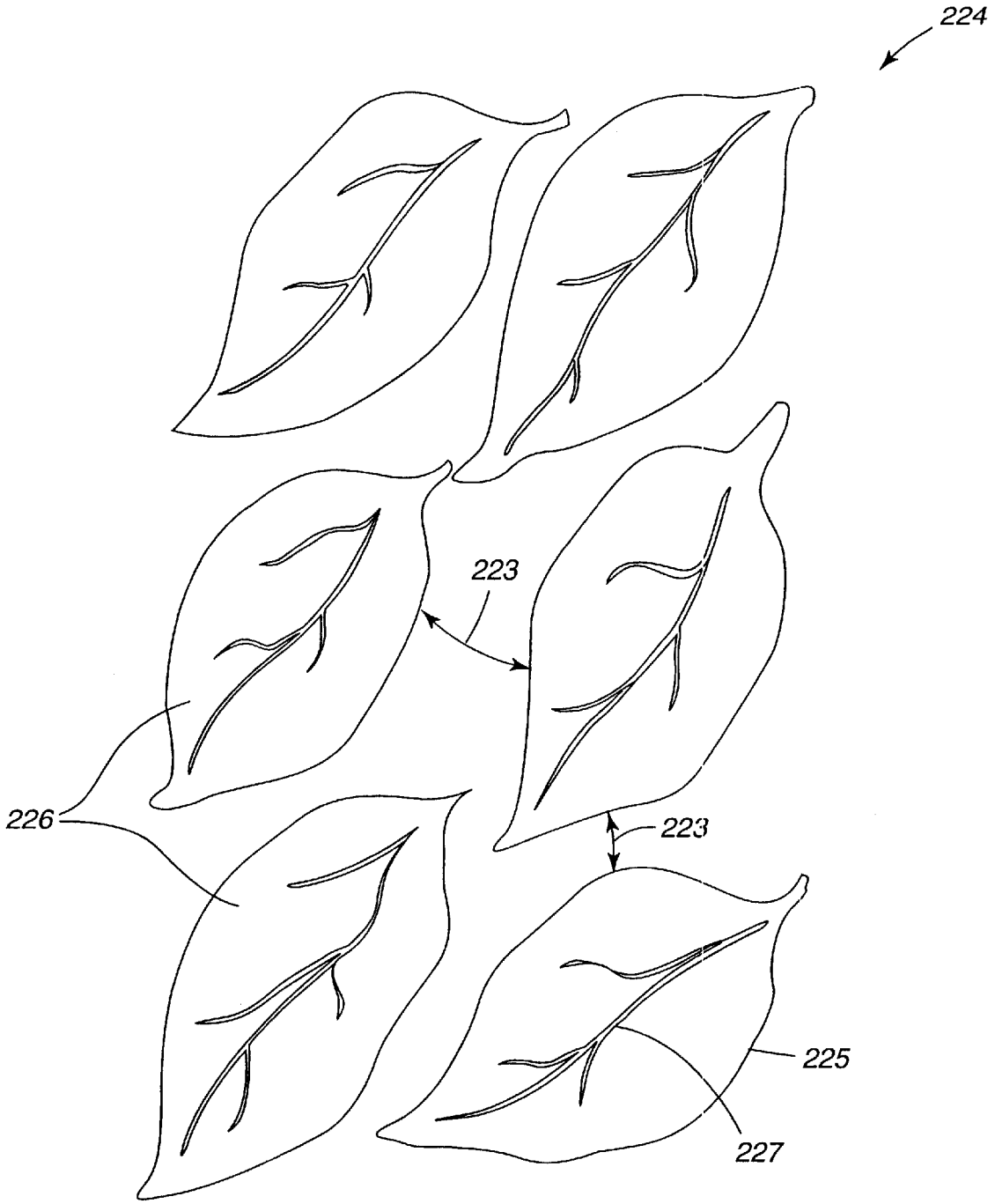
FIG. 10 is a plan view of the multiple leaf shaped foam patterns of the roller cover of FIG. 2 as it would appear in a plane.

Also in the same manner as the other roller cover embodiments described above, FIGS. 2 and 10 illustrate a foam layer 224 of another embodiment having six representative foam patterns 226. The six foam patterns 226 are each preferably shaped to represent an aspen leaf with natural looking periphery 225. As with the prior embodiments, the foam layer 224 is preferably smoothly wrapped around and attached to a core 221, as shown in FIG. 2, so that the core 221 is substantially covered by the foam layer 224 leaving side regions 229 free of foam. The aspen leaf shape of the patterns 226 and the orientation of the patterns 226 on the core 221 result in the general non-contacting engagement of the foam patterns 226 when the foam layer 224 is wrapped about the core 221. As a result of such engagement of the patterns 226, the periphery 225 of the foam patterns 226 form a number of non-uniform gaps, representatively referenced as 223, that each partially wind about the core 221. In addition, each foam pattern 226 is provided with slits in the foam resulting in inner edges 227 representing leaf veins.

Figure 11:
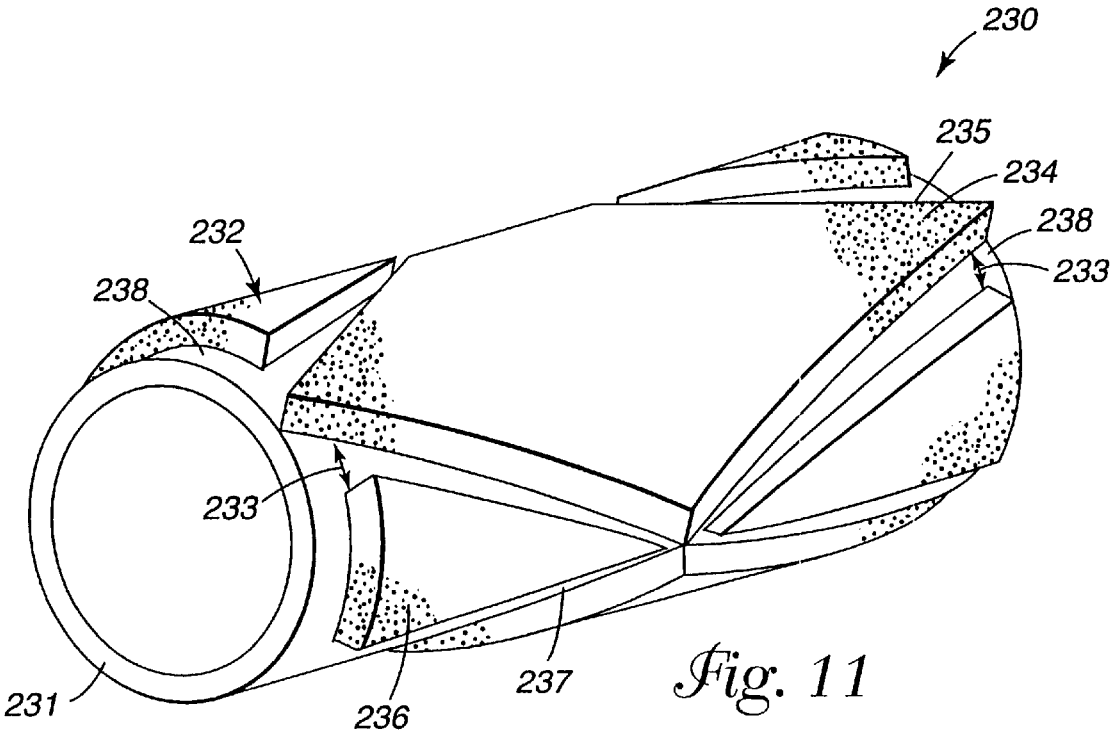
FIG. 11 is a perspective view of another roller cover useable with the roller paint applicator of FIG. 1, having a plurality of diamond and triangle foam patterns thereon.
Figure 12:
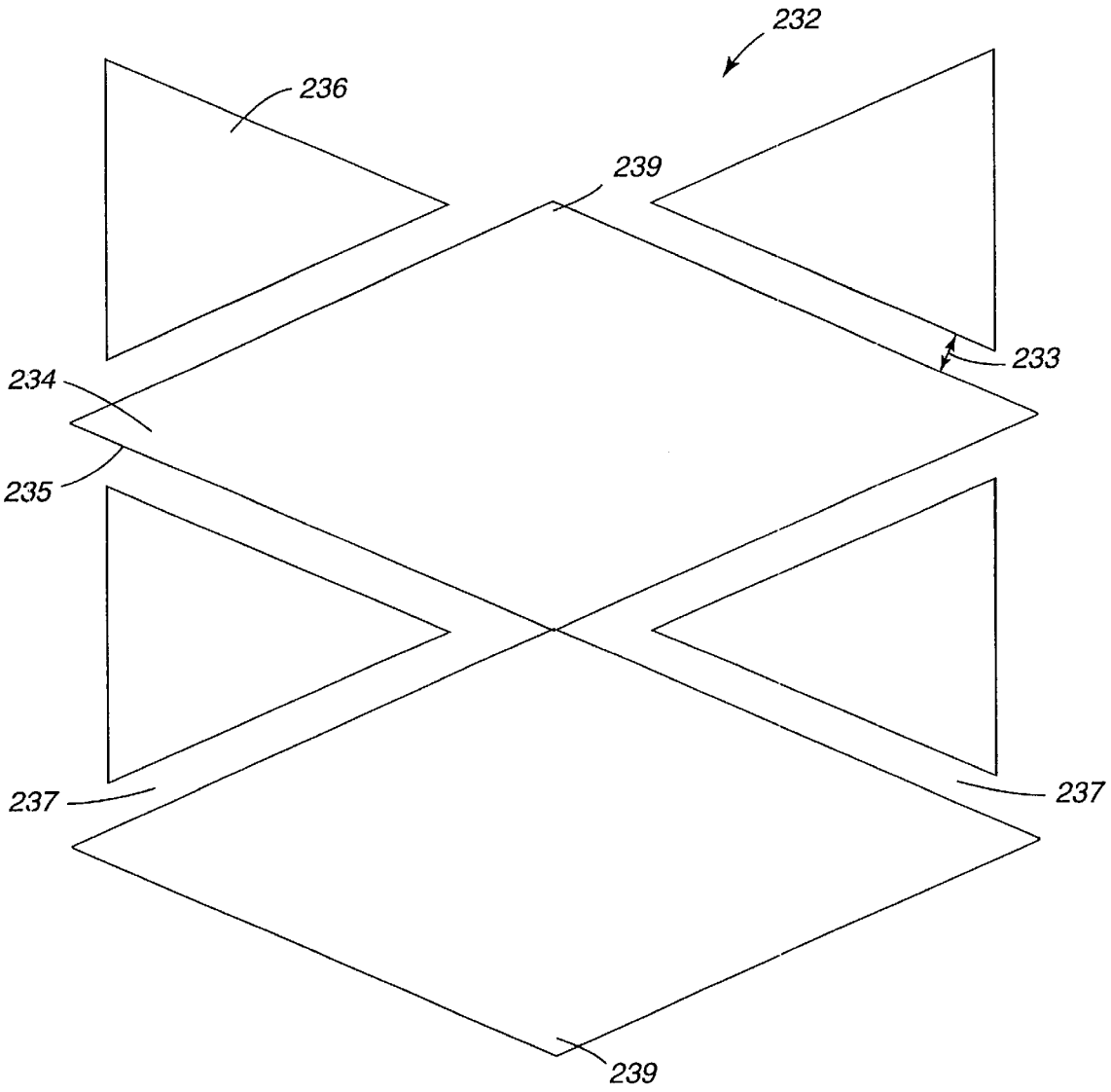
FIG. 12 is a plan view of the diamond and triangle foam patterns of the roller cover of FIG. 11 as they would appear in a plane.

Another representative foam pattern embodiment is illustrated in FIGS. 11 and 12. In this embodiment, a roller cover 230 is shown having a core 231 and a foam layer 232 that includes a combination of geometric shapes including large elongated diamond shaped foam patterns 234 and smaller triangle shaped foam patterns 236. The two elongated diamond patterns 234 are positioned adjacent each other so that the corners along the short axis 239 are abut when the foam patterns 234 are attached to the core 231. When so positioned, the edges 235 of the diamond shaped foam patterns 234 form triangular spaces 237 into which the triangular shaped patterns 236 are interposed. The triangular shaped foam patterns 236 are sized and positioned in the triangular spaces 237 to form appropriately sized gaps 233 between the foam patterns 234, 236. In the same manner described above for the other embodiments, when the foam layer 232 is wrapped about the core 231 the side regions 238 are free of foam.

The creation of a faux finish on a desired surface under the present invention requires the application of a coating, such as paint, to the desired surface by a dual roller paint applicator 100, as shown in FIG. 1, that includes a desired pair of roller covers 120, 124. The dual roller covers 120, 124 of the dual roller paint applicator 100 facilitate the simultaneous application of at least two paints to the desired surface. In order to achieve the faux finish, the two paints must have at least one different visually perceptible characteristic. These characteristics can include hue, intensity, saturation, luminescence, shade, tint, glossiness, pearlescence, or other visually perceptible phenomena.

The first step in producing the faux finish on the desired surface is the application of the two different paints to the two roller covers 120, 124, respectively, on a dual roller paint applicator 100. This step may be referred to as loading the roller covers with paint. A dual compartment paint pan, two separate paint pans, or other appropriate means known in the art, may be used to accomplish this step of the process. The foam layers 122, 126, respectively, of the roller covers 120, 124 absorb some of the paints, thus allowing for subsequent application of the paints to the desired surface.

The second step of the process is the application of the two paints on the two roller covers 120, 124 to the desired surface. This application occurs by contacting the foam layers 122, 126 of the two roller covers 120, 124 of the dual roller paint applicator 100 with the desired surface, such as a surface to be coated 162 shown in FIG. 13. The paint on the outer surface 127 of the foam layers 122, 126 transfers to the surface 162 on contact. Paint absorbed into the foam layers 122, 126 transfers to the surface upon application of pressure between the roller covers 120, 124 and the surface to be coated 162.

Figure 13:
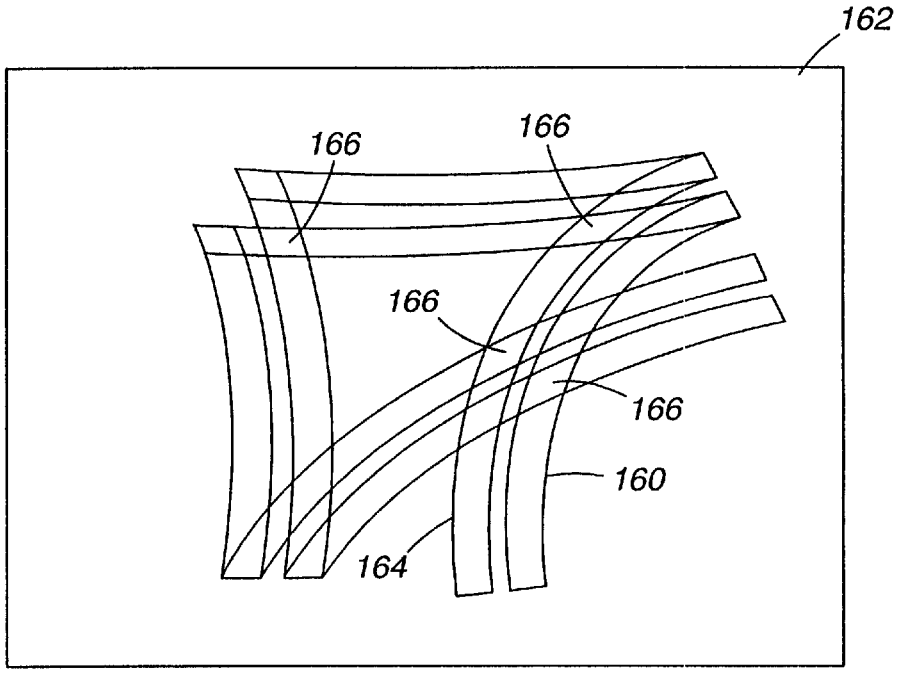
FIG. 13 is a plan view of a vertical surface such as a wall demonstrating one application technique using the apparatus of the present invention.

The dual roller paint applicator 100 is then moved about the surface 162 in a substantially continuous overlapping and arcing motion, keeping the roller covers 120, 124 in contact with the surface 162. As shown in FIG. 13, each roller cover 120, 124 produces a paint band 160, 164, respectively. The overlapping and arcing motion causes an overlapping of the two paint bands 160, 164 resulting in blended paint areas 166. The arcing motion should occur while the roller covers 120, 124 are rolling on the surface 162 in order to minimize the possibility of producing smeared or feathered paint effects. The overlapping and arcing motion is repeated across the whole surface to be coated 162, reloading the roller covers 120, 124 with paint as needed, until the surface 162 is coated with paint to the desired degree and the desired faux finish is created. The repeated overlapping of the two paint bands 160, 164 results in a blended, yet non-uniform variegated appearance of paint upon the coated surface 162.

As the roller covers 120, 124 are loaded with paint and passed over the surface to be coated 162, the paint discharges at the edges of the foam layers 122, 126. This discharged paint leaves edge discharge marks shaped like sections of an edge or partial outlines of the foam patterns 128, 129 of the foam layers 122, 126. Further passes of the roller covers overlapping the edge discharge marks may obscure the marks or blend the paints. Desired edge discharge marks may be kept on the surface 162 by not over-rolling them with further paint. The selective application of pressure to a roller cover 120, 124 against the surface 162 causes more pronounced edge discharge marks by that roller cover 120, 124. Pressure may be varied as the handle is moved in the overlapping and arcing motion in order to produce more pronounced edge discharge marks from either roller cover 120, 124, as desired. FIGS. 14–18 illustrate the resulting appearance of painted surfaces after using a dual roller paint applicator 100 having two roller covers with the raised foam patterns shown in FIGS. 5, 8, 9, 10 and 12. The edge discharge marks 174, 184, 192, 243, 253, respectively, from the discharged paint are shown with blended paint areas 172, 182, 191, 242, 252 on surfaces 170, 180, 190, 240 and 250.

The differences in visually perceptible characteristics between the two paints cause the edge discharge marks 174, 184, 192, 243, 253 left by the edge discharge to be visible when the edge discharge marks 174, 184, 192, 243, 253 are not obscured by additional application of paint. The greater the difference in characteristic between the two paints, the more pronounced the edge discharge marks 174, 184, 192, 243, 253 become against the blended paint areas 172, 182, 191, 242, 252.

Figure 14:
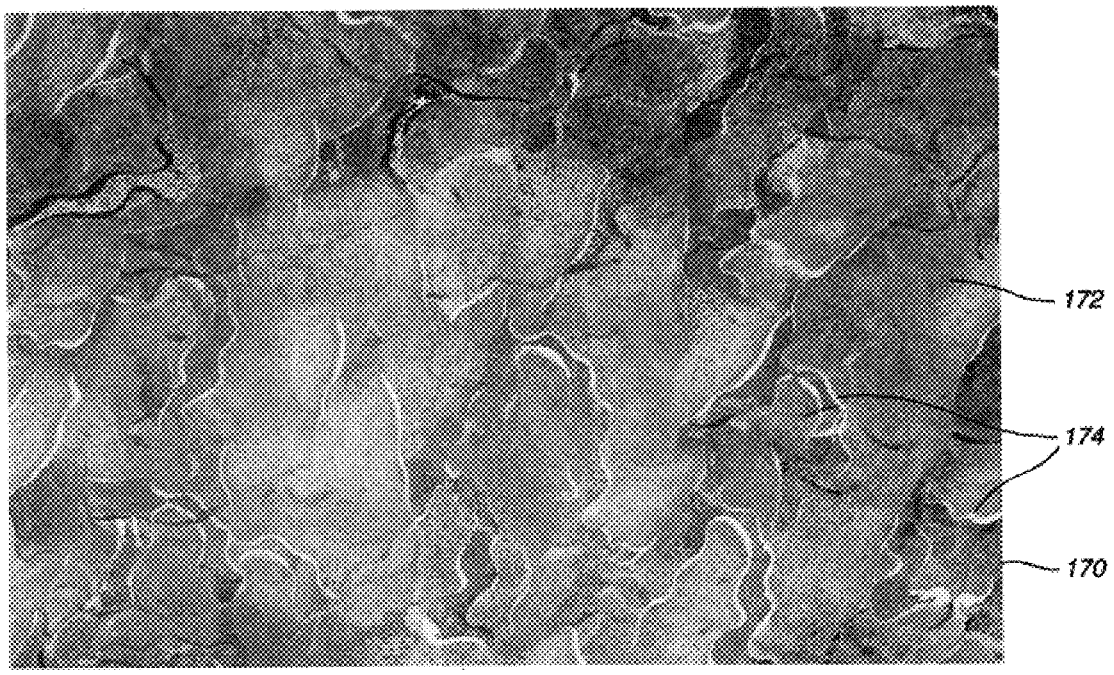
FIG. 14 is photograph/plan view of a surface upon which a faux marble finish has been applied by the apparatus of the present invention using two roller covers of the type shown in FIG. 3 mounted on the dual roller paint applicator of FIG. 1.
Figure 15:
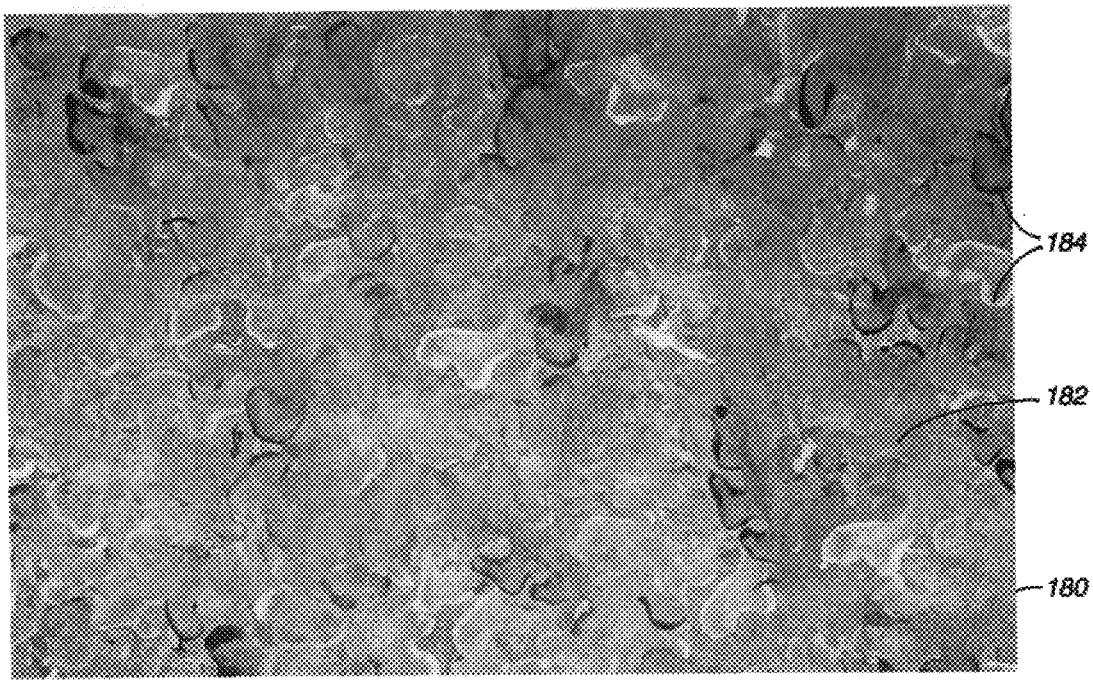
FIG. 15 is a photograph/plan view of a surface upon which a faux marble finish has been applied by the apparatus of the present invention using two roller covers of the type shown in FIG. 6 mounted on the dual roller paint applicator of FIG. 1.
Figure 16:
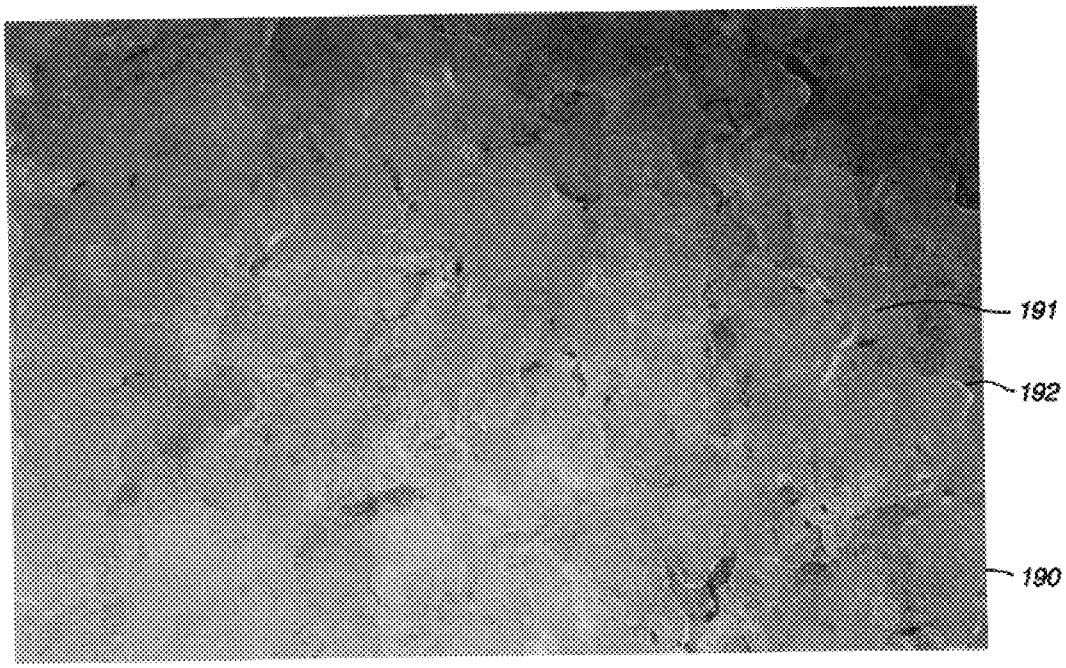
FIG. 16 is a photograph/plan view of a surface upon which a faux marble finish has been applied by an apparatus of the present invention using two roller covers each with the multiple foam patterns shown in FIG. 9 mounted on the dual roller paint applicator of FIG. 1.

As shown in FIG. 14, the undulating periphery 137 of the nonrepresentational single foam pattern 136 causes well-defined vein-like edge discharge marks 174 that are clear against the blended areas 172. This distinct combination of vein-like edge discharge marks 174 overlaid upon the blended, yet non-uniform variegated background produces an aesthetically pleasing and recognizably marble-like appearance. This type of appearance is labeled Faux Marble. As shown in FIG. 15, the serpentine periphery 147, 149 of the two nonrepresentational foam patterns 146, 148 cause globular edge discharge marks 184 that are still apparent, but less distinct than the veining of FIG. 14, against the blended areas 182. The globular edge discharge marks 184 overlaid upon the blended, yet non-uniform variegated background produces a more muted, but still aesthetically pleasing and recognizably marble-like appearance. Likewise, as shown in FIG. 16, the undulating periphery 197 of the six nonrepresentational foam patterns 196 also cause well-defined, but segmented vein-like edge discharge marks 192 that are clear against the blended areas 191. These segmented vein-like edge discharge marks 192 differ from those shown in FIG. 14 in that they tend to be shorter, but more numerous, and angle off of one another in a distinctive vein-like manner. However, this combination of segmented vein-like edge discharge marks 192 overlaid upon the blended, yet non-uniform variegated background also produces an aesthetically pleasing and recognizably marble-like appearance.

Figure 17:
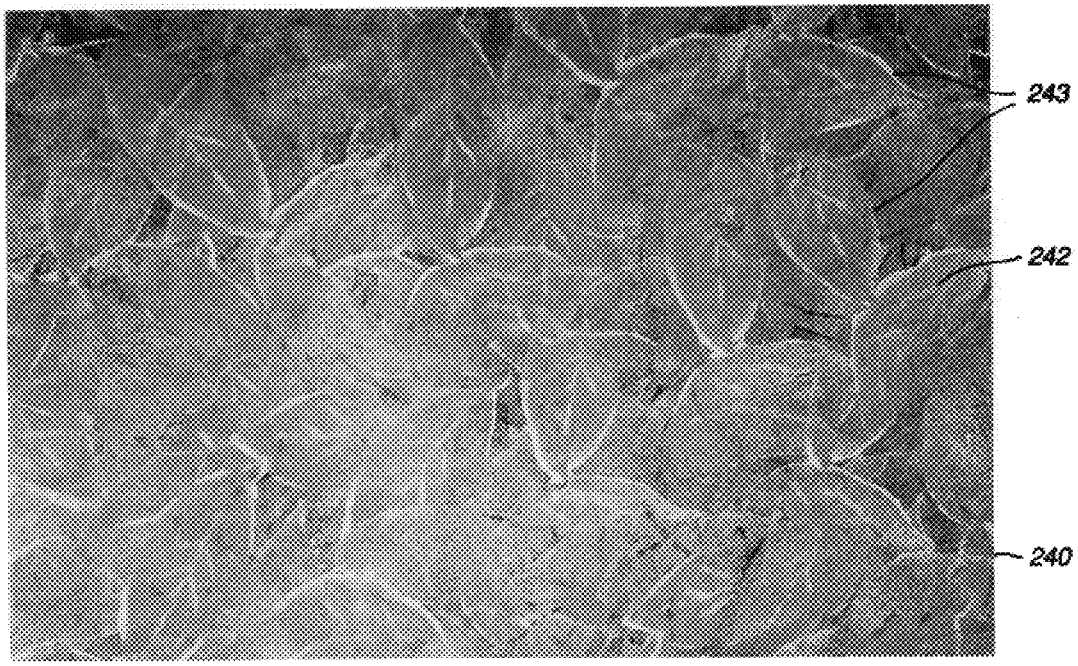
FIG. 17 is a photograph/plan view of a surface upon which a faux texture finish has been applied by an apparatus of the present invention using two roller covers each with the multiple leaf shaped foam patterns shown in FIG. 10 mounted on the dual roller paint applicator of FIG. 1.
Figure 18:
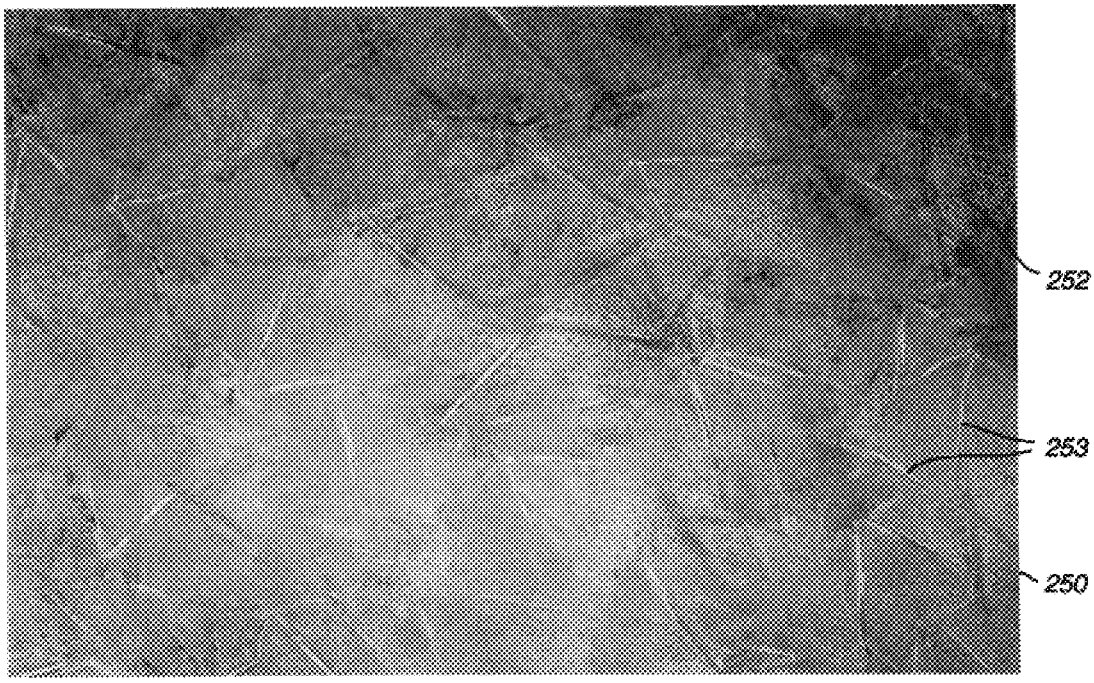
FIG. 18 is a photograph/plan view of a surface upon which a faux texture finish has been applied by an apparatus of the present invention using two roller covers of the type shown in FIG. 11 mounted on the dual roller paint applicator of FIG. 1.

In FIG. 17, however, the aspen leaf shaped periphery 225 of the multiple foam patterns 226 produce well-defined leaf-shaped edge discharge marks 243 that are clear against the blended areas 242. This distinct combination of leaf-shaped edge discharge marks 243 overlaid upon the blended, yet non-uniform variegated background produces an aesthetically pleasing and recognizable overlapping leaves effect. The overlapping leaves effect appears to give texture and depth to the surface 240, even though only a single layer of paint has been applied. This type of appearance is labeled Faux Texture. FIG. 18 also provides a Faux Texture appearance caused by the diamond and triangle shaped foam patterns 234, 236, respectively. The angled edge discharge marks 253 are clear against the blended areas 252, and produce an aesthetically pleasing leather-like effect that also gives the appearance of depth and texture to the surface 250.

The present invention has been illustrated by a number of specific foam pattern designs each shown with one specific image representing a faux finish. It should be understood that the choice of paints or coatings, especially the difference in visually perceptible characteristic chosen, combined with the application technique used by the user will affect the resulting faux finish provided by each foam pattern of the present invention. Each application will be unique, yet may be substantially similar to another application if the foam pattern and paints are the same. The user has the ability to manipulate the dual roller paint applicator to produce a faux finish having very defined edge discharge marks, a faux finish that is extremely blended with only subtle edge discharge marks, or any variation in between. This ability of the user to manipulate the applicator to produce a faux finish to his or her liking makes the present invention extremely versatile and user friendly. No particular training is required, and the ease of use makes the invention readily available for use by consumers, instead of being limited only to professionals or trained individuals, as the prior faux finish techniques have been. The apparatus of the present invention is easy to manufacture, and relatively inexpensive to produce, thereby making it a relatively inexpensive decorating option for consumers, that will produce professional quality and decorative results.

Although the present invention has been illustrated by a number of specific foam pattern designs, the invention is not to be taken as limited to only these designs. Any variations in foam pattern design that produce a faux finish, such as a faux marble or faux texture appearance, are contemplated and within the scope of the present invention.

The invention is not to be taken as limited to all of the details thereof as modifications and variations thereof may be made without departing from the spirit or scope of the invention.

What is claimed is:

1. An apparatus for creating a faux finish on a surface, the apparatus comprising:

a) a dual roller handle; and b) a pair of roller covers each mounted for independent rotation thereon and each including a core and a raised foam pattern mounted to the core, the core including a pair of core ends and a circumferential area between the pair of ends, the foam pattern having an outer foam surface, a perimeter and distinct edges at least at the perimeter of the foam pattern, with the foam pattern sized, shaped and positioned about the core to create adjacent edges and a gap between the adjacent edges when the foam pattern is received on the core, the foam pattern covering a substantial portion of the circumferential area of the core so as to provide each roller cover with a substantial area of the outer foam surface, the core being free of foam at least at the gap and around substantially all of the circumferential area of each core end, the foam pattern of one roller cover adapted to absorb a paint having at least one different visually perceptible characteristic than a paint absorbed by the foam pattern of the other roller cover so as to apply the paint from the outer surfaces of the foam patterns onto a surface when the apparatus is moved in an overlapping motion over the surface, blending the paints on at least a portion of the surface by movement of the outer foam surfaces of the foam patterns of the pair of roller covers over the surface, the edges of each foam pattern configured to discharge the respective paints as distinct but muted edge discharge marks that appear as at least fragmentary portions of an outline of the raised foam pattern, with the edge discharge marks of one foam pattern distinguishable from the edge discharge marks of the other foam pattern due to the different visually perceptible characteristic of the paint and with the edge discharge marks combining with blended paint portions to produce the faux finish on the surface with at least some edge discharge marks overlaid upon the blended paint portions.

2. The apparatus of claim 1, wherein the at least one different visually perceptible characteristic is selected from among one or more of the group consisting of hue, intensity, saturation, luminescence, shade, tint, glossiness and pearlescence of the paint.

3. The apparatus of claim 1, wherein at least a portion of the edge discharge marks are overlaid upon a blended, yet non-uniform variegated paint on the surface and are not totally obscured by further application of the paints to the surface.

4. The apparatus of claim 1, wherein each roller cover comprises a single raised foam pattern thereon.

5. The apparatus of claim 4, wherein the single raised foam pattern comprises an undulating edge, the undulating edge creating well-defined vein-like edge discharge marks in the faux finish resulting in a veined marble appearance.

6. The apparatus of claim 1, wherein each roller cover comprises two raised foam patterns thereon.

7. The apparatus of claim 6, wherein each raised foam pattern comprises a serpentine edge, the serpentine edges creating globular edge discharge marks in the faux finish resulting in a variegated marble appearance.

8. The apparatus of claim 7, wherein both raised foam patterns are the same.

9. The apparatus of claim 1, wherein each roller cover comprises a plurality of raised foam patterns thereon.

10. The apparatus of claim 9, wherein each raised foam pattern comprises an undulating edge, the undulating edges creating segmented vein-like edge discharge marks in the faux finish resulting in a veined marble appearance.

11. The apparatus of claim 9, wherein each raised foam pattern comprises a leaf shaped perimeter, the edges at the leaf shaped perimeter creating leaf shaped edge discharge marks in the faux finish resulting in a textured appearance of overlapping leaves.

12. The apparatus of claim 11, wherein each leaf shaped foam pattern further comprises internal edges, the internal edges creating leaf vein edge discharge marks in the overlapping leaves faux finish.

13. The apparatus of claim 9, wherein the plurality of raised foam patterns comprise:

a first plurality of elongated diamond shaped foam patterns having a long axis, a short axis, and a diamond shaped perimeter, and a second plurality of triangular shaped foam patterns having a triangle shaped perimeter, the diamond shaped patterns positioned adjacent each other such that comers along the short axis substantially abut, forming triangular shaped spaces between the first plurality of diamond shaped foam patterns with the triangle shaped patterns interposed in the triangular shaped spaces, the edges at the diamond and triangle shaped perimeters creating angular edge discharge marks in the faux finish resulting in a leather-like textured appearance.

14. The apparatus of claim 1, wherein each roller cover has the same raised foam pattern thereon as the other roller cover.

15. The apparatus of claim 1, wherein the foam is an open-celled foam.

16. The apparatus of claim 15, wherein the foam is a polyester polyurethane foam.

17. The apparatus of claim 16, wherein the foam has a density of about 1.9 pounds per cubic foot.

18. The apparatus of claim 17, wherein the foam has a pore count range of about 55 to 65 pores per inch.

19. The apparatus of claim 17, wherein the foam has a pore count range of about 70 to 90 pores per inch.

20. The apparatus of claim 1, wherein the foam pattern thickness ranges from about 0.25 to about 0.5 inches.

21. The apparatus of claim 1, wherein the core of each roller cover further comprises a length and a diameter.

22. The apparatus of claim 21, wherein the core comprises plastic.

23. The apparatus of claim 22, wherein the core comprises PVC.

24. The apparatus of claim 21, wherein the core comprises phenolic.

25. The apparatus of claim 21, wherein the core comprises cardboard coated with a moisture resistant coating.

26. The apparatus of claim 21, wherein the core length ranges from about 4 to about 7 inches.

27. The apparatus of claim 21, wherein the core diameter ranges from about 1.5 to about 1.75 inches.

28. An apparatus for creating a faux marble finish on a surface, the apparatus comprising:

a) a dual roller handle; and b) a pair of roller covers each mounted for independent rotation thereon and each including a core and a raised foam pattern mounted to the core, the core including a pair of core ends and a circumferential area between the pair of ends, the foam pattern having an outer foam surface, a perimeter and distinct edges at least at the perimeter of the foam pattern, with the foam pattern sized, shaped and positioned about the core to create adjacent edges and a gap between the adjacent edges when the foam pattern is received on the core, the foam pattern covering a substantial portion of the circumferential area of the core so as to provide each roller cover with a substantial area of the outer foam surface, the core being free of foam at least at the gap and around substantially all of the circumferential area of each core end, the foam pattern of one roller cover adapted to absorb a paint having at least one different visually perceptible characteristic than a paint absorbed by the foam pattern of the other roller cover so as to apply the paint from the outer surfaces of the foam patterns onto a surface when the apparatus is moved in an overlapping motion over the surface, blending the paints on at least a portion of the surface by movement of the outer foam surfaces of the foam patterns of the pair of roller covers over the surface, the edges of each foam pattern configured to discharge the respective paints as distinct but muted edge discharge marks that appear as at least fragmentary portions of an outline of the raise foam pattern giving the appearance of marble veins, with the edge discharge marks of one foam pattern distinguishable from the edge discharge marks of the other foam pattern due to the different visually perceptible characteristic of the paint and with the edge discharge marks combining with blended paint portions to produce the faux finish on the surface with at least some edge discharge marks overlaid upon the blended paint portions.

29. The apparatus of claim 28, wherein the edge discharge marks comprise globular marks in the faux marble finish.

30. The apparatus of claim 28, wherein the edge discharge marks comprise segmented vein-like marks in the faux marble finish.

* * * * *

UNITED STATES PATENT AND TRADEMARK OFFICE

CERTIFICATE OF CORRECTION

PATENT NO. : 6,330,731 B1
DATED : December 18, 2001
INVENTOR(S) : Susan A. Jackson et al.

It is certified that error appears in the above-identified patent and that said Letters Patent is hereby corrected as shown below:

Column 9,
Line 41, the word "comers" should be corrected to read -- corners --.

Signed and Sealed this

Twenty-eighth Day of May, 2002

*Attest:*

*Attesting Officer*

JAMES E. ROGAN
*Director of the United States Patent and Trademark Office*